US006539197B2

(12) United States Patent
Waterschoot

(10) Patent No.: US 6,539,197 B2
(45) Date of Patent: Mar. 25, 2003

(54) PRINTER CLEANING DEVICE

(75) Inventor: William Waterschoot, Belsele (BE)

(73) Assignee: Xeikon International N.V., Lier (BE)

( * ) Notice: Subject to any disclaimer, the term of this patent is extended or adjusted under 35 U.S.C. 154(b) by 0 days.

(21) Appl. No.: 09/792,230

(22) Filed: Feb. 23, 2001

(65) Prior Publication Data

US 2001/0018003 A1 Aug. 30, 2001

(30) Foreign Application Priority Data

Feb. 24, 2000 (GB) ..... 0004428

(51) Int. Cl.[7] ..... G03G 21/00
(52) U.S. Cl. ..... 399/353
(58) Field of Search ..... 399/353–355, 399/358

(56) References Cited

U.S. PATENT DOCUMENTS 4,402,103 A 9/1983 Yanagawa et al.
4,506,975 A 3/1985 Shukuri et al.
4,956,677 A * 9/1990 Akiyama ..... 399/353
5,212,530 A * 5/1993 Harada et al. ..... 399/353
5,231,456 A 7/1993 Nishimura
5,260,754 A * 11/1993 Yano et al. ..... 399/353
5,663,788 A * 9/1997 Sanpe ..... 399/353
5,999,791 A * 12/1999 Ogawa et al. ..... 399/354

OTHER PUBLICATIONS

Abstract, JP58114074 Konishiroku (1983).
Abstract JP8111078 Konishiroku (1983).
Abstract JP8111077 Konishiroku (1983).

* cited by examiner

*Primary Examiner*—William J. Royer
(74) *Attorney, Agent, or Firm*—Knobbe, Martens, Olson & Bear, LLP

(57) ABSTRACT

A cleaning device, being part of a copying or printing system, for removing residual developer from the surface of an image-delivering member is described. The device includes a cleaning brush in rolling contact with the surface of the image-delivering member for removing residual developer therefrom. A biased collecting roller is in rolling contact with the revolving brush. The collecting roller is biased such as to attract the residual developer from the cleaning brush and to collect it onto its surface. A trailing cleaning blade has a forward end portion in frictional contact with the collecting roller. The trailing cleaning blade is in contact with the cleaning roller at a contact position where the collecting roller is moving in an upward direction. Also disclosed is a method for removing developer from a surface of an image-delivering member.

18 Claims, 5 Drawing Sheets

PRINTER CLEANING DEVICE

FIELD OF THE INVENTION

The present invention is related to a cleaning device applicable to an electrostatic recording system, such as for instance a copying or a printing system, in order to remove residual developer from the surface of an image-forming member.

BACKGROUND OF THE INVENTION

In a typical printing or copying process, a charged latent image is formed on an image-forming member by image-wise exposure. The image-forming member can be an endless member such as a drum or a belt. Typical graphical processes include amongst others magnetography, ionography and electrography, particularly electrophotography. In the latter process for instance, the charged latent image is formed on a pre-charged photosensitive member by image-wise exposure to light. The latent image is subsequently made visible on the image-forming member with developer at a development zone, the developer comprising, or consisting of, charged toner. After the development of the latent image, the developed image is transferred to a recording medium, directly or via one or more intermediate image-carrying members, where it may be permanently fixed. Examples of intermediate image-carrying members are endless belts. In practice the transfer from an image-delivering member being either an image-forming member or an intermediate image-carrying member to an image-receiving member being either an intermediate image-carrying member or a recording medium may be incomplete. Multiple subsequent transfers are possible. In normal operating conditions, typical transfer efficiencies range from 95% to 100%. The residual image on the image-delivering member has to be removed because otherwise the image quality of subsequently formed or transferred images can be seriously disturbed.

This residual image has to be removed before re-entering into the development zone. Otherwise this could lead to serious image defects because of mixing up of the new developed or transferred image with the residual image.

This cleaning action is executed by a cleaning station positioned downstream from the transfer zone. The cleaning station comprises at least a revolving brush which can be engaged against the image-delivering member for removing residual developer therefrom, a high voltage collecting roller in rolling contact with the brush roller for brush de-toning and a scraper blade contacting the high voltage roller for scraping developer therefrom.

The cleaning of the high voltage roller is a problem. This roller is a rigid roller in rolling contact with the cleaning brush. In the contact zone, developer is transferred to the high voltage roller by biasing the high voltage roller such that an attractive electrical field is created. A cleaning blade is positioned downstream of the contact zone to scrape off the developer from the high voltage roller. Usually to maximize force, the cleaning blade is positioned at an obtuse contact angle. The contact angle is defined with respect to a line tangent to the point of contact of the cleaning blade with the rotating high voltage roller and is the angle between this tangent line, at the uncleaned section of the roller, and the cleaning blade. This obtuse contact angle is typically between 160 and 170 degrees. The cleaning blades used as such are usually very stiff and rigid amongst others to prevent flip over of the cleaning blade as for instance when there is no developer on the roller. As a consequence, more elastic cleaning blades are unsuited because such flip over is detrimental both with respect to the lifetime of the blade and the cleaning efficiency. A cleaning blade mounted at an obtuse contact angle is typically made of an incompressible rigid material such as stainless steel.

In U.S. Pat. No. 4870466 (Iida, assigned to Ricoh) a cleaning blade is disclosed which is mounted at an acute contact angle, i.e. a trailing cleaning blade, with respect to the high voltage roller. However, the contact angle disclosed seems to be clearly smaller than 45 degrees. As a result, the contact area between the cleaning blade and the high voltage roller is rather large. It is found that cleaning at such small angles is inefficient. Moreover, the cleaning blade is mounted such that the waste toner which is removed from the high voltage roller can not fall down freely to be further removed, but instead, at least to some extent, will build up between the roller and the cleaning blade and as such may even push the cleaning blade away from the high voltage roller.

OBJECTS OF THE INVENTION

It is an object of the present invention to provide a cleaning blade to scrape off developer and debris from the surface of a collecting roller, being used as a brush de-toning device in a cleaning unit.

It is a preferred object of the invention to mount the cleaning blade such that the cleaning blade has a good cleaning ability for an extended period of time and that the waste developer which is scraped off the high voltage roller is allowed to freely fall down to be further removed by a revolving auger and/or an air flow.

It is a further preferred object of the invention to provide a compressible cleaning blade, which is not damaged when exposed to carrier particles and other debris, which may be present on the surface of the high voltage roller.

It is still a further preferred object of the invention to provide a wear-resistant cleaning blade and an associated mounting position which allows for an efficient cleaning of a collecting roller having a fairly rough surface, i.e. with Ra ranging from 0.05 to 0.15.

SUMMARY OF THE INVENTION

According to a first aspect of the invention there is provided a cleaning device being part of a copying or printing system for removing residual developer from the surface of an image-delivering member comprising:

- a cleaning brush in rolling contact with said surface of said image-delivering member for removing residual developer therefrom, said cleaning brush being rotatable in a first predetermined direction;
- a collecting roller in rolling contact with said revolving brush, said collecting roller being rotatable in a second predetermined direction;
- means for biasing said collecting roller to generate an electrical field which attracts the residual developer from the cleaning brush and collects it onto its surface; and
- a cleaning blade having a forward end portion in frictional contact with the collecting roller wherein, in an operative orientation of the device, said cleaning blade is in contact with said collecting roller at a contact position where the collecting roller is moving in an upward direction, said cleaning blade being mounted such that the contact angle (as hereinbefore defined) is less than 90 degrees.

In an embodiment of the invention, the cleaning device is retractable. The cleaning device is a part of a copying or printing system and is intended for removing residual developer from the surface of an image-delivering member such as for instance an image-forming member or an image-carrying member. Examples of image-forming members are drums or belts with a photoreceptive or a magneto-sensitive outer layer. Examples of image carrying members are seamed or seamless intermediate transfer belts. Such an intermediate transfer belt may be composed of an electrically semi-insulating or insulating material with a low surface energy, or comprises at least a top coating of such a material. Examples of such a material are polyesters such as e.g. Hytrel 7246, polyimides, polycarbonates or dissipative polymer blends.

The collecting roller in rolling contact with said revolving brush is electrically biased such that an electrical field is generated which attracts the residual developer from the cleaning brush and collects it onto its surface.

The cleaning blade is preferably composed of an elastic material with a hardness ranging from 50 to 80 Shore A.

We are aware that cleaning blades are widely used, particularly for cleaning the image-forming member. In electrophotography the image-forming member is usually a drum or a belt covered with an organic photo-conductive layer. The cleaning of this smooth sensitive layer can however in no way be compared with the cleaning of the high voltage roller, which is usually an incompressible rigid roller. Irrespective of the positioning of the cleaning blade, the force required to completely remove the residual developer from the image-forming layer is such that the image-forming layer is damaged. In practice, the cleaning blade is usually mounted such that the image-forming member is not damaged which by consequence results in an incomplete cleaning. Therefore, extra cleaning means are provided, e.g. in the form of a revolving cleaning brush in rolling contact with the image-forming members, to improve cleaning results.

The developer used in the recording system with which the cleaning device according to the invention is associated can be a mono-component or a two-component developer. A common development technique uses a two-component developer material of toner particles adhering triboelectrically to larger carrier beads. When the developer material, contained in a developer unit, is placed in an appropriate magnetic field, the carrier beads with the toner thereon form a magnetic brush. As the carrier beads and the toner particles are oppositely charged, in the development zone the toner particles are attracted from the carrier beads to develop the latent image on the image-forming member. In case of a two-component developer it is clear that both the developed image and the residual image are primarily composed of toner particles. However, due to failures, as e.g. wrong sign carrier beads, very small numbers of carrier beads may be transferred to the image-forming member in the development zone and subsequently picked up by the cleaning brush and thereafter collected on the collecting roller. Contrary to e.g. a metal cleaning blade mounted at an obtuse contact angle, the cleaning blade of the present invention easily removes such hard carrier beads without causing damage to the blade.

The cleaning brush rotates in a first predetermined direction, which is preferably opposite to the propagation direction of the image-delivering member. The collecting roller contacts the cleaning brush and rotates in a second predetermined direction, preferably opposite to said first predetermined direction. The collecting roller may be a freely rotating roller or may be driven. The cleaning brush and the collecting roller may be independently driven and their rotation speed may be independently controlled. The collecting roller is incompressible and electrically conductive and bias means are provided to apply a voltage to the collecting roller in order to create an electrical field which is attractive for the developer gathered on the cleaning brush.

The cleaning blade according to the present invention is preferably an elastic cleaning blade with a hardness in the range from 50 to 85 Shore A. The rebound resilience is typically in the range from 20 to 40%. Preferably a polyurethane cleaning blade is used. The cleaning blade is mounted at an acute contact angle. The thickness of the cleaning blade is typically between 1.5 mm and 4 mm. The cleaning blade is partly attached to a support such that the free portion of the cleaning blade has a length typically in the range from 4 to 11 mm. The free portion of the blade is the portion which is not attached to the support. The blade material is compressible and the thickness and free length of the blade are chosen such that at least the forward end portion of the blade is allowed to bend slightly while in contact with the collecting roller, i.e. while exerting pressure on the blade. Particularly the blade is positioned such that the pressure exerted by the blade on the collecting roller would correspond to an impression of the blade in the incompressible collecting roller ranging from 0.25 mm to 1 mm. The cleaning blade is mounted such that it contacts the collecting roller at a position where the collecting roller moves in an upward direction. This enables waste developer being scraped off the collecting roller to freely fall down and inhibits potential build up of waste material between the blade and the collecting roller.

In an embodiment of the invention, the cleaning blade is mounted such that the acute contact angle of the cleaning blade with respect to the collecting roller is in the range from 60 to 80 degrees. It has been observed that smaller contact angles result in inefficient cleaning, more particularly, a contact angle below 60 degrees causes developer filming on the collecting roller which results in a decreased de-toning ability of the collecting roller and consequently in a less efficient cleaning of the image-delivering member. Moreover, a blade mounted at such a small contact angle is not able to remove carrier beads from the surface of the collecting roller. In an embodiment of the invention, the collecting roller is composed of a metal. Particularly, aluminum or steel can be used. In such case, the surface of the collecting roller may be hard anodized to increase at least the hardness of the roller. Alternatively, a ceramic coating may be provided as a surface layer. Particularly the surface can have an average roughness, Ra, in the range from 0.05 to 0.15.

In an embodiment of the invention, the cleaning device further comprises an auger, being positioned below the collecting roller to remove the waste developer, which is scraped off the collecting roller by the cleaning blade. An air flow may be provided to assist in the removal of the waste developer. Alternatively, instead of an auger, only an air flow may be provided to remove the waste.

According to another aspect of the invention, there is provided a method for cleaning a surface of an image-delivering member, which is a part of a copying or printing system, the method comprising the steps of:

contacting the outer surface of said image-delivering member with a cleaning brush to remove residual developer therefrom, said cleaning brush rotating in a first predetermined direction;

establishing a rolling contact between said revolving brush and a collecting roller rotating in a second predetermined direction, biasing said collecting roller such that an electrical field is generated which attracts said residual developer from said cleaning brush and collects it onto its surface; and scraping off said collected residual developer from said surface of said collecting roller with a cleaning blade, said cleaning blade having a forward end portion in frictional contact with the collecting roller at a contact position where the collecting roller is moving in an upward direction, said cleaning blade being mounted such that the contact angle (as hereinbefore defined) is less than 90 degrees.

BRIEF DESCRIPTION OF THE DRAWINGS

The invention will now be further described, purely by way of example, with reference to the accompanying drawings, in which.

DETAILED DESCRIPTION OF THE INVENTION

In relation to the appended drawings the present invention is described in detail as follows. It is apparent however that a person skilled in the art can imagine several other equivalent embodiments or other ways of executing the present invention, the spirit and scope of the present invention being limited only by the terms of the appended claims.

Figure 1:
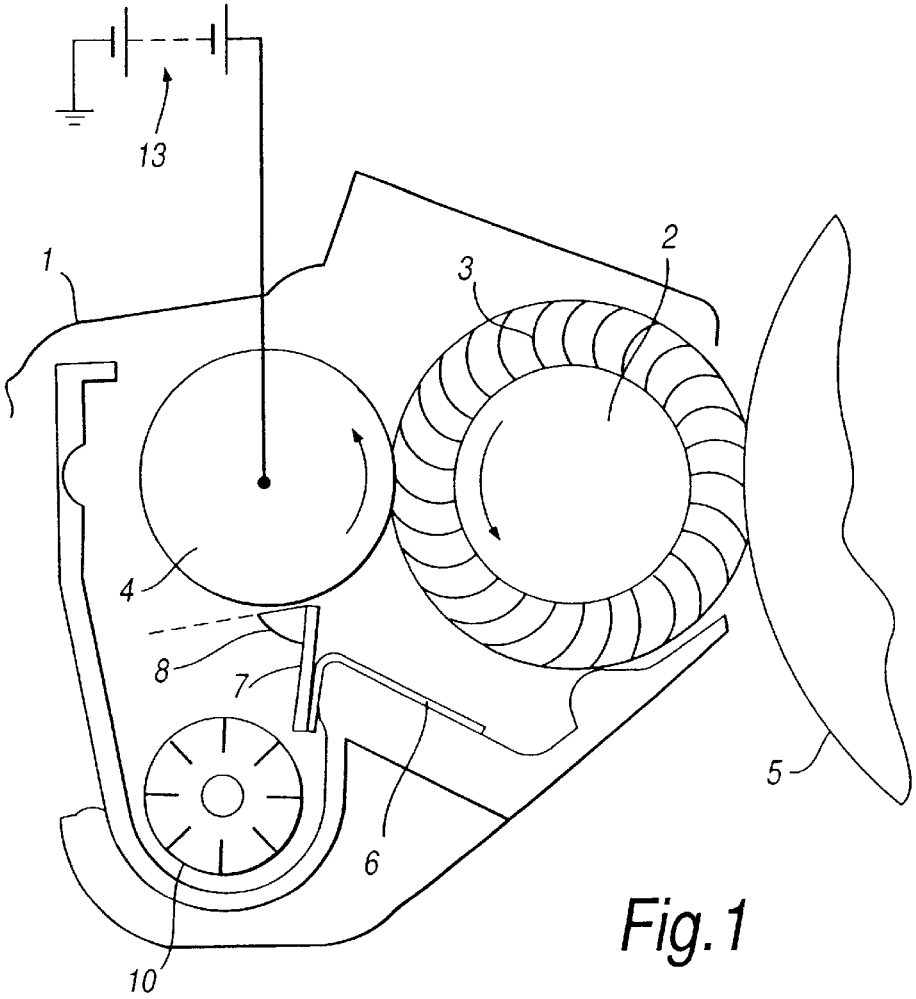
FIG. 1 depicts a schematic representation of a cleaning device according to an embodiment of the invention.

According to a preferred embodiment of the invention, FIG. 1 depicts a schematic representation of a retractable cleaning device 1, which is engaged into contact with the surface of an image-delivering member 5. Particularly, a rotating cleaning brush 2 having bristles 3 extending therefrom contacts the surface. The bristles remove the residual image from the surface of the image-delivering member. Particularly as a two-component developer is used, the residual image is primarily composed of charged toner particles. More particularly, negatively charged toner particles are used. It should however be clear that the present invention is in no way limited to the removal of negatively charged toner particles. The cleaning device of the present invention can easily cope with positively charged toner particles or other types of developer. Preferably the direction of movement of the cleaning brush is opposite to the direction of movement of the image-delivering member. A rotating collecting roller 4 is placed adjacent said rotating cleaning brush such that portions of said rotating cleaning brush selectively contact said collecting roller in a contact zone as said cleaning brush rotates. Particularly, the collecting roller is a steel roller with an average surface roughness, Ra, of 0.09. Bias means generally indicated by reference 13 are provided to apply a voltage to the collecting roller to establish an attractive electrical field in the contact zone between the cleaning brush and the collecting roller. The voltage applied to the collecting roller is typically in the range from 300 V to 1000 V. A polyurethane cleaning blade 7 contacts the collecting roller at a position where the collecting roller moves in an upward direction. The cleaning blade is partly attached to a support 6. The attachment is executed by means of an adhesive. The free portion of the cleaning blade has a length of 7 mm. The cleaning blade has a thickness of 2 mm, a hardness of 70 Shore A and a rebound resilience of 31%. The rebound resilience is determined prior to the mounting by attaching both ends of the blade to two fixed points and measuring the rebound of a reference weight which is dropped on the blade. The cleaning blade is mounted at an acute contact angle 8 with respect to the collecting roller.

Figure 2A:
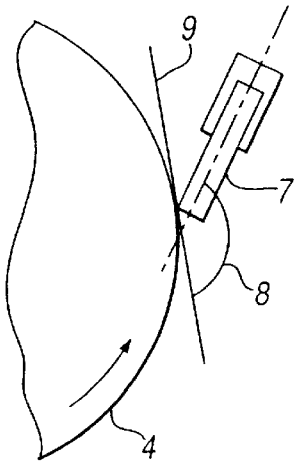
Fig.2A (Prior Art)
FIG. 2A depicts a schematic prior art representation of the positioning of a cleaning blade with respect to a moving image-delivering member. The cleaning blade is mounted at an obtuse contact angle with respect to the image-delivering member.
Figure 2B:
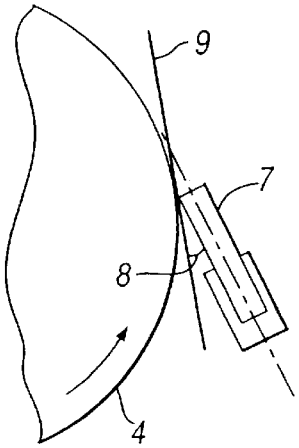
FIG. 2B depicts, according to an embodiment of the present invention, a schematic representation of the positioning of a cleaning blade with respect to a moving image-delivering member. The cleaning blade is mounted at an acute contact angle with respect to the image-delivering member.

As schematically depicted in FIG. 2B, the contact angle, defined as the angle 8 between the portion of the line 9, tangent to the collecting roller 4 at said contact position and extending towards the uncleaned portion of the collecting roller, and said cleaning blade 7, is 69 degrees. This is in contrast to the prior-art embodiment shown in FIG. 2A, where, to maximize force, the cleaning blade is usually positioned at an obtuse contact angle. The contact angle 8 is defined with respect to a line 9 tangent to the point of contact of the cleaning blade 7 with the rotating collecting roller or high voltage roller 4 and is the angle between this tangent line, at the uncleaned section of the roller, and the cleaning blade.

In the device according to the invention, the cleaning blade is mounted as such efficiently scrapes off the developer collected on the collecting roller. The cleaning blade also efficiently removes debris and carrier beads from the collecting roller without being damaged. The waste which is removed from the collecting roller can freely fall down and is further removed by a revolving auger 10.

Figure 3:
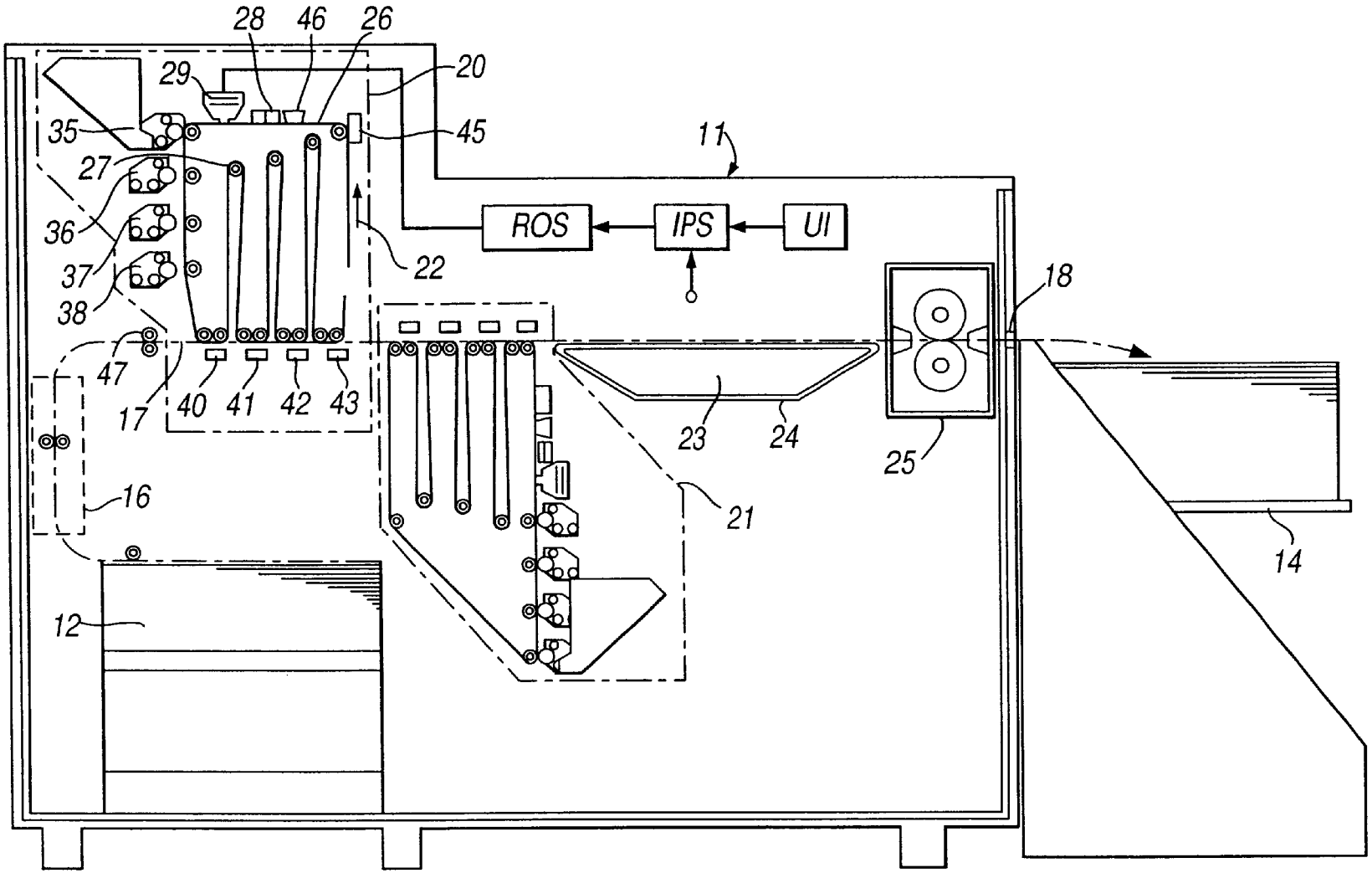
FIG. 3 depicts a printing system incorporating a cleaning unit according to an embodiment of the invention.

In a first example, see FIG. 3, a schematic representation of an electrophotographic duplex color printer is depicted, incorporating the cleaning unit according to the present invention. The printer comprises a light-tight housing 11, which has at its inside a stack 12 of sheets to be printed. At its output the printer has a platform 14 onto which the printed sheets are received. A sheet to be printed is removed from stack 12 and is fed through an alignment station 16. As the sheet leaves the alignment station, it follows a straight horizontal path 17 up to output section 18 of the printer. The speed of the sheet, upon entering said path, is determined by driven pressure roller pair 47. A number of processing stations are located along the path 17. A first image-forming unit 20 indicated in a dash-and-dot line is provided for applying a multi-color image to the obverse side of the sheet and is followed by a second station 21 for applying a multi-color image to the reverse sheet side. A buffer station 23 then follows, with an endless transport belt 24 for transporting the sheet to a fuser station 25. As both image forming units are similar to each other, only unit 20 will be described in more detail hereinafter.

An endless photoconductor belt 26 is guided over a plurality of rollers 27 to follow a path in the direction of arrow 22 to advance successive portions of the photoconductive surface sequentially through the various processing stations disposed along the path of movement thereof. The photoconductive belt may comprise a base layer of polyethylene terephthalate of 100 μm thickness covered with a thin layer of aluminum as a back electrode (less than 0.5 μm thickness). The organic photoconductor (OPC) layer is on top of the aluminum layer and is from 15 μm in thickness. The belt is arranged such that the photoconductive layer is positioned on the outside of the belt loop.

Initially, a portion of the photoconductive belt 26 passes through charging station 28. At the charging station, a charge-generating device electrostatically charges the belt to a relatively high, substantially uniform potential, i.e. the dark potential. Next, the belt passes to an exposure station 29. Exposure station 29 exposes the photoconductive belt to successively record four latent color separation images by image-wise discharging the belt. Thereafter, the belt advances these images to the development unit. This unit includes four individual developer stations 35, 36, 37 and 38 with for example cyan, yellow, magenta and black developer. During development of each electrostatic latent image only one developer station is in the operative position (developer station 35 in FIG. 3). The developer used is two-component developer consisting of non-permanently magnetised magnetic carrier beads having toner particles adhering triboelectrically thereto. A magnetic brush of developer particles is formed in the operative developer station adjacent the photoconductive belt. The negatively charged toner particles are attracted by an electrical field from the magnetic brush to thereby develop the corresponding latent image on the photoconductive belt. Each latent image is developed subsequently using the developer station of the corresponding color to thereby form four spaced-apart subsequently developed images on the photoconductive belt.

After their development, the toner images are moved to toner image transfer stations 40, 41, 42 and 43 where they are transferred on a sheet of support material, such as plain paper or transparent film. At the transfer stations, the sheet follows the rectilinear path 17 into contact with photoconductive belt 26. The sheet is advanced in synchronism with the movement of the belt such that at each transfer station an image is transferred to the paper in perfect register one onto the other to thereby form a registered multi-color image on the sheet. After transfer of the four images, the belt, which acts both as an image-delivering and an image-forming member, is directed towards a cleaning unit 45, which is positioned downstream from the transfer stations. In the cleaning unit a rotating fibrous-like brush contacts the photoconductive belt 26 to remove residual developer particles remaining after the transfer operation. Cleaning unit 45 is identical to the cleaning unit 10 (FIG. 1) as described above. Thereafter, lamp 46 illuminates the belt to remove any residual charge remaining thereon prior to the start of a next cycle.

Figure 4:
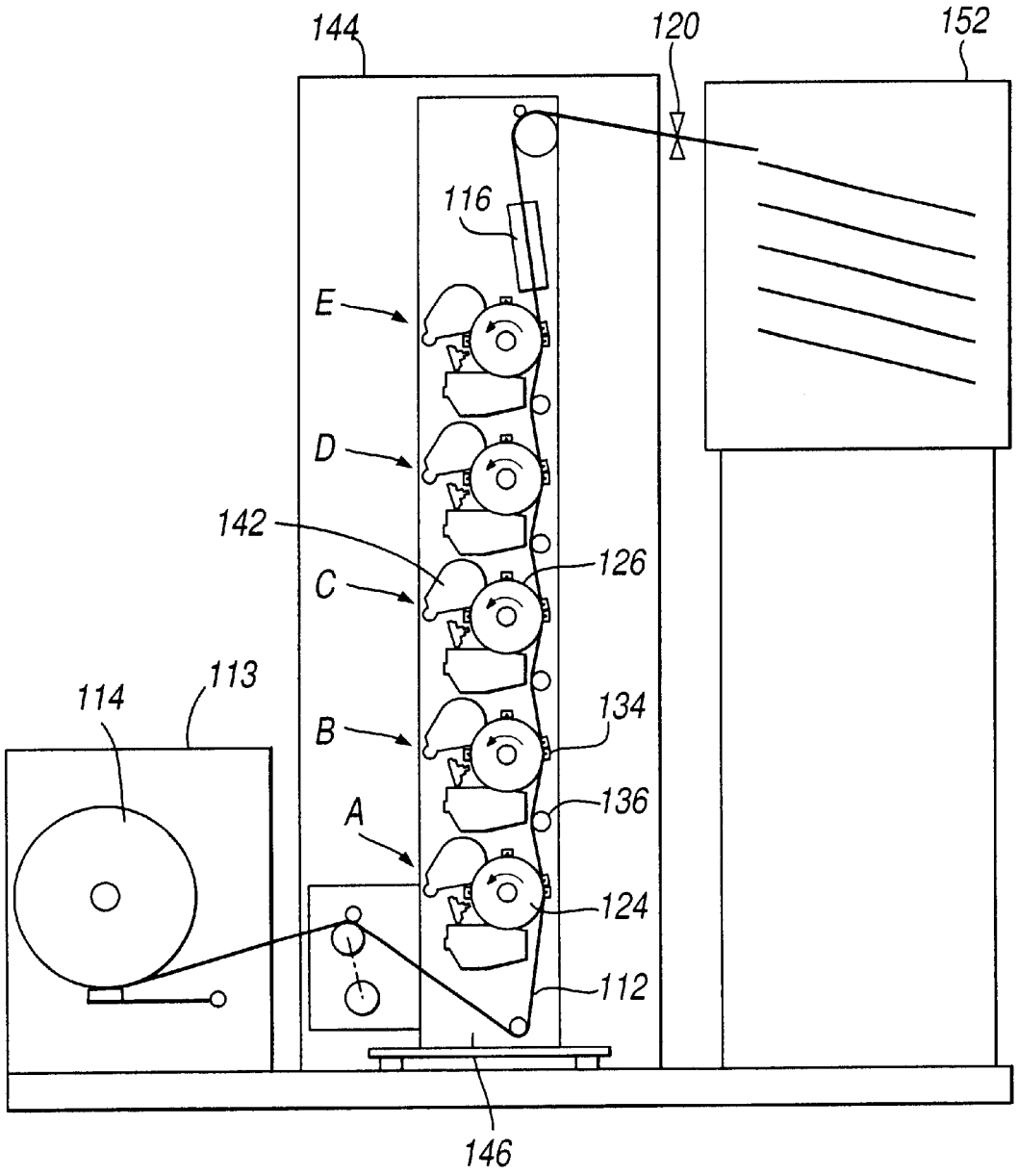
FIG. 4 depicts a printing system incorporating a cleaning unit according to an embodiment of the invention.
Figure 5:
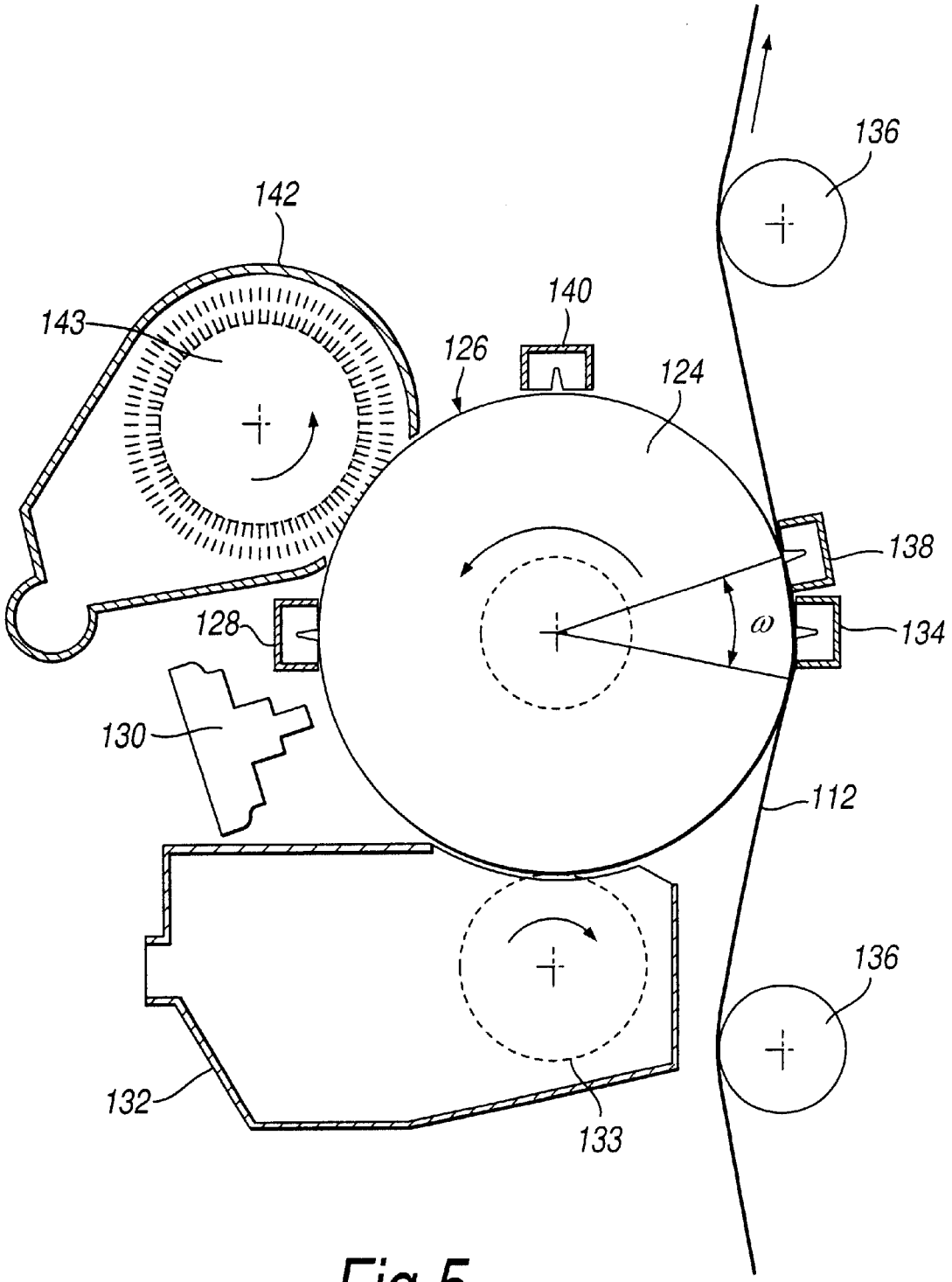
FIG. 5 depicts an image-forming station according to an embodiment of the invention.

In a second example, see FIG. 4, a schematic representation of another electrophotographic color printer is depicted incorporating cleaning units according to the present invention. This printer has a supply station 113 in which a roll 114 of web material 112 is housed. The web 112 is conveyed into a tower-like printer housing 144 in which a support column 146 is provided housing at least four printing stations A–D, e.g. black, yellow, magenta and cyan. (In the fig. an extra printing station E is provided, allowing to optionally add an additional color.) As shown in figure 5, each printing station comprises a cylindrical drum 124 having a photoconductive outer surface 126. The drum acts both as an image-delivering member and as an image-forming member. Circumferentially arranged around the drum 124 there is a main charge generating device 128 capable of charging the drum surface to a high potential of about −600 V, i.e. the dark potential, an exposure device 130 will image-wise discharge (e.g. to a potential of about −250 V) the surface 126 to thereby form a latent image. This latent image is developed on the drum by the developer station 132 by contacting the drum with a magnet brush of a two-component developer of non-permanently magnetised magnetic carrier beads having toner particles adhering triboelectrically thereto formed on the surface of a magnet roller 133. Negatively charged toner particles are attracted to the exposed (discharged) areas of the photoconductive surface. After development, the toner image on the drum surface is transferred to the moving web 112 by a transfer corona device 134 which generates an attractive electrical field for the negatively charged toner particles. This transfer corona together with the guiding rollers 136 establishes also a strong adherent contact between the web and the drum over an angle of about 15 degrees which causes the latter to be rotated in synchronism with the movement of the web 112 and urges the toner particles into firm contact with the surface of the web 112. A web discharge corona 138 is provided to establish a controlled release of the web. Thereafter the drum surface is pre-charged by a charge generating device 140 to a potential between 0 and −600 V both for facilitating the charging by the main charge generating device and to facilitate the removal of residual images on the drum surface by a cleaning unit 142. Cleaning unit 142 is similar to the cleaning unit 10 (FIG. 1) as described above. The cleaning unit includes an adjustably mounted fibrous-like cleaning brush 143, the position of which can be adjusted towards or away from the drum surface to ensure optimum cleaning. The cleaning brush 143 is grounded or subject to such a potential with respect to the drum as to attract the residual developer particles away from the drum surface. The rest of cleaning unit 142 is similar to the cleaning unit 10 (FIG. 1) as described above. The rotatable cleaning brush 143 which is driven to rotate in a sense the same as to that of the drum 124 and at a peripheral speed of, for example twice the peripheral speed of the drum surface. The developer station 132 includes a magnetic roller with a brush formed thereon 133 which rotates in a sense opposite to that of the drum 124. The resultant torque applied to the drum by the rotating developing brush 133 and the counter-rotating cleaning brush 143 is adjusted to be close to zero, thereby ensuring that the only torque applied to the drum is derived from the adherent force between the drum and the web.

After a first image of a first color is formed and transferred to the web in a first print station, the web passes successively the other print stations where images of other colors are formed and transferred in register to thereby form a registered multi-color image on the web. After leaving the final print station E, the image on the web is fixed by means of the image fixing station 116 and fed to a cutting station 120 and a stacker 152 if desired.

Figure 6:
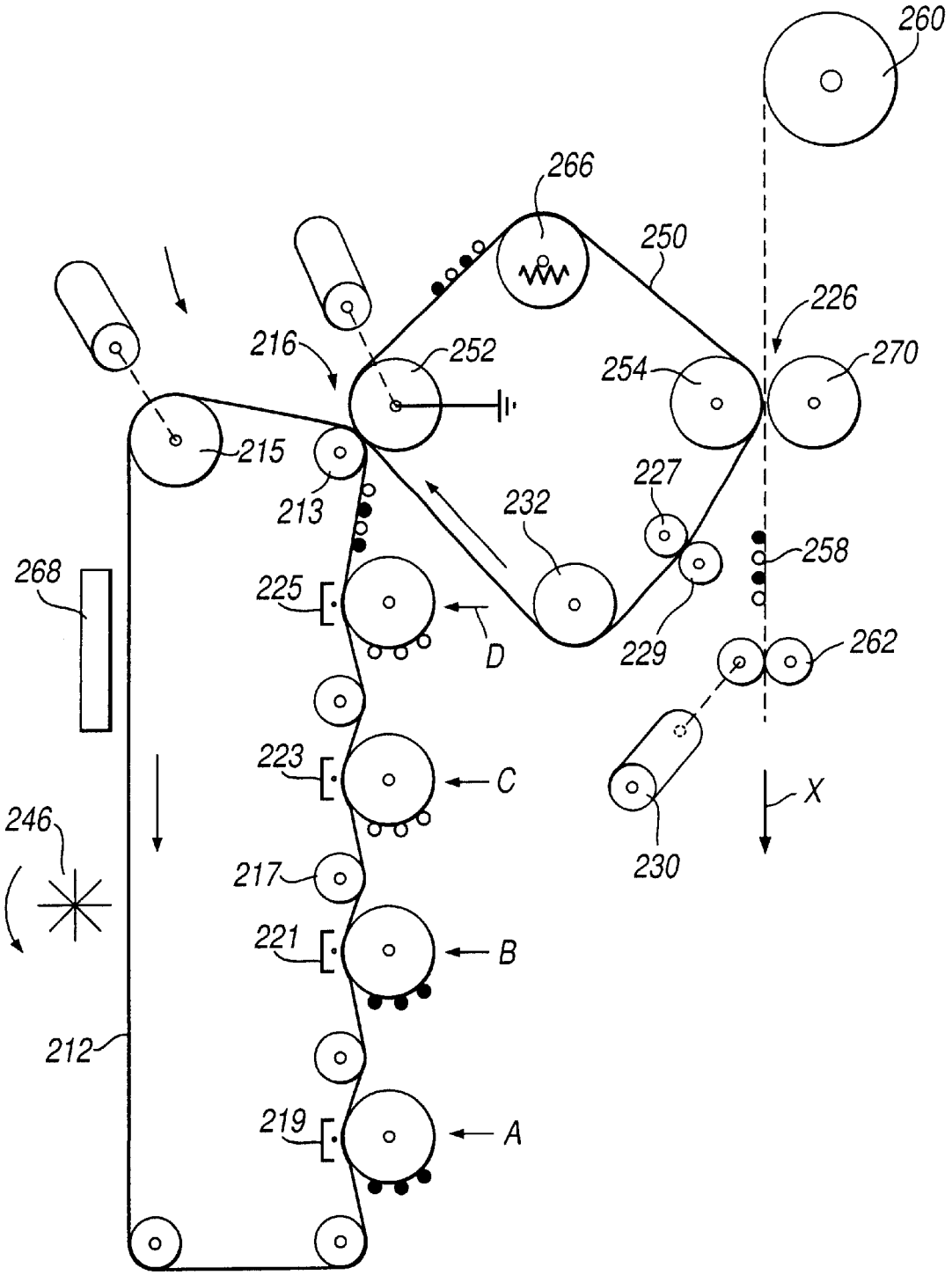
FIG. 6 depicts a printing system incorporating a cleaning unit according to an embodiment of the invention.

In a third example, see FIG. 6, a schematic representation of an electrophotographic color printer is depicted incorporating cleaning units according to the present invention. The printer comprises a primary transfer belt 212 formed of polyethylene terephthalate (PET) having a thickness of 100 m and having spaced along one run thereof a plurality of toner image-forming stations A, B, C, D. Each of these stations is similar as described in FIG. 5 and example 2. Charge generating devices 219, 221, 223, 225 are provided to subsequently electrostatically transfer a toner image of a particular color from each image-forming station to the PET belt 212 while the belt is advanced over a number of guide rollers 217 along the stations to thereby form a registered multi-color toner image. The primary transfer belt 212 acts as an image-delivering member.

At the intermediate transfer nip, the multi-color toner image is transferred to an intermediate transfer belt 250. The intermediate transfer nip 216 is formed between the guide roller 213 and an opposing guide roller 252 pressed towards each other to cause tangential contact between said primary transfer belt 212 and the heated intermediate transfer belt 250. The guide roller 213 comprises an electrically conductive core carrying a semi-insulating covering. A supply of electrical potential is provided for electrically biasing at least the first guide roller 213 to create an electrical field at the intermediate transfer nip 216 to assist in transferring the image from the primary belt 212 to the intermediate transfer belt 250.

The primary transfer belt 212, with the residual image thereon passes thereafter through a cooling station 268, where the belt is forcibly cooled by directing cooled air onto the primary transfer belt 212. Alternatively, instead of blowing cooled air a cooling liquid such as water may be directed through roller 215 to cool the primary transfer belt. The primary transfer belt 212 is thereby cooled to a temperature of about 35 C. This cooling assists in establishing the required temperature gradient at the intermediate transfer nip 216. The residual toner image on the primary transfer belt 212 is removed by cleaning unit 246 before the deposition of further developed toner images thereon. The cleaning unit 246 is similar to the cleaning unit 10 (FIG. 1) as described above.

The intermediate transfer belt 250 with the transferred multi-color image is advanced over a heated roller 266 to a final transfer station 226. The final transfer station 226 comprises a nip formed between a guide roller 254 of the intermediate transfer belt 250 and a counter roller 270, through which nip the intermediate transfer belt 250 and a substrate in the form of a paper web 258 pass in intimate contact with each other. Drive rollers 262, driven by a motor 230, drive the web 258 in the direction of the arrow X from a supply roll 260 continuously through the final transfer station 226 where it is pressed against the intermediate transfer belt 250 by the counter roller 270. At this final transfer zone, the multi-color image is transferred from the intermediate transfer belt to the paper web.

Downstream of the final transfer station 226, the intermediate transfer belt 250 passes through a cleaning station comprising a tacky cleaning roller 229 opposed to a counter roller 227, and thereafter over a steering and tensioning roller 232, before returning to the intermediate transfer nip 216.

What is claimed is:

1. A cleaning device being part of a copying or printing system for removing residual developer from the surface of an image-delivering member comprising:

a cleaning brush in rolling contact with the surface of the image-delivering member for removing residual developer therefrom, the cleaning brush rotating in a first predetermined direction;

a collecting roller in rolling contact with the cleaning brush, the collecting roller rotating in a second predetermined direction;

a voltage source for biasing the collecting roller to generate an electrical field which attracts the residual developer from the cleaning brush and collects the residual developer onto the surface of the collecting roller; and a cleaning blade having a forward end portion in frictional contact with the collecting roller wherein, in an operative orientation of the device, the cleaning blade is in contact with the collecting roller at a contact position where the collecting roller is moving in an upward direction, the cleaning blade being mounted such that a contact angle defined as the angle between the portion of a line tangent to the collecting roller at the contact position and extending towards an uncleaned portion of the collecting roller and the cleaning blade is less than 90 degrees.

2. The device as recited in claim 1, wherein the cleaning blade is formed of polyurethane.

3. The device as recited in claim 1, wherein the cleaning blade is composed of an elastic material with a hardness ranging from 50 to 80 Shore A.

4. The device as recited in claim 3, wherein the contact angle is a fixed angle in the range from 60 to 80 degrees.

5. The device as recited in claim 3, wherein the collecting roller is a rigid roller with a Ra in the range from 0.05 to 0.15.

6. The device as recited in claim 5, wherein the collecting roller is a hard anodized aluminum or steel roller.

7. The device as recited in claim 3, wherein the length of a free portion of the cleaning blade is in the range from 4 to 9 mm.

8. The device as recited in claim 7, wherein the cleaning blade is pressed against the collecting roller with a force corresponding with an impression between 0.25 and 1 mm.

9. The device as recited in claim 1, wherein the cleaning device further comprises a removal device positioned below the collecting roller for removing waste developer scraped off from the collecting roller by the cleaning blade.

10. A method for cleaning a surface of an image-delivering member, which is a part of a copying or printing system, the method comprising:

contacting the outer surface of the image-delivering member with a cleaning brush for removing residual developer therefrom, the cleaning brush rotating in a first predetermined direction;

establishing a rolling contact between the cleaning brush and a collecting roller, the collecting roller rotating in a second predetermined direction;

biasing the collecting roller such that an electrical field is generated which attracts the residual developer from the cleaning brush and collects the residual developer onto the surface of the collecting roller; and scraping off the collected residual developer from the surface of the collecting roller with a cleaning blade, the cleaning blade having a forward end portion in frictional contact with the collecting roller at a contact position where the collecting roller is moving in an upward direction, the cleaning blade being mounted such that a contact angle defined as the angle between the portion of a line tangent to the collecting roller at the contact position and extending towards an uncleaned portion of the collecting roller and the cleaning blade is less than 90 degrees.

11. The method according to claim 10, wherein the cleaning blade is formed of polyurethane.

12. The method according to claim 10, wherein the cleaning blade is composed of an elastic material with a hardness ranging from 50 to 80 Shore A.

13. The method according to claim 12, wherein the contact angle is a fixed angle in the range from 60 to 80 degrees.

14. The method according to claim 12, wherein the collecting roller is a rigid roller with a Ra in the range from 0.05 to 0.15.

15. The method according to claim 14, wherein the collecting roller is a hard anodized aluminum or steel roller.

16. The method according to claim 12, wherein the length of a free portion of the cleaning blade is in the range from 4 to 9 mm.

17. The method according to claim 16, wherein the cleaning blade is pressed against the collecting roller with a force corresponding with an impression between 0.25 and 1 mm.

18. The method according to claim 10, further comprising collecting waste developer scraped off from the collecting roller by the cleaning blade.

* * * * *